US010731929B2

(12) United States Patent
Janezich et al.

(10) Patent No.: US 10,731,929 B2
(45) Date of Patent: Aug. 4, 2020

(54) HEAT EXCHANGER WITH TANKS, TUBES AND RETAINER

(71) Applicant: L & M Radiator, Inc., Hibbing, MN (US)

(72) Inventors: Robert Janezich, Hibbing, MN (US); Aaron Patrick Morgan, Britt, MN (US); Charles Eugene Cedar, Jr., Chisholm, MN (US); Todd Gregory Dosen, Side Lake, MN (US); Paul R. Shuey, Pine City, MN (US)

(73) Assignee: L & M Radiator, Inc., Hibbing, MN (US)

( * ) Notice: Subject to any disclaimer, the term of this patent is extended or adjusted under 35 U.S.C. 154(b) by 0 days.

(21) Appl. No.: 16/367,883

(22) Filed: Mar. 28, 2019

(65) Prior Publication Data

US 2019/0219343 A1 Jul. 18, 2019

Related U.S. Application Data

(63) Continuation of application No. 15/008,505, filed on Jan. 28, 2016, now Pat. No. 10,267,576.

(51) Int. Cl.
*F28F 9/02* (2006.01)
*F28F 9/06* (2006.01)
(Continued)

(52) U.S. Cl.
CPC ..... *F28F 9/02* (2013.01); *F28D 1/05366* (2013.01); *F28D 7/0066* (2013.01); *F28F 9/04* (2013.01); *F28F 9/06* (2013.01); *F28F 2230/00* (2013.01)

(58) Field of Classification Search
CPC ..... F28F 9/02; F28F 9/04; F28F 9/06; F28F 2230/00; F28D 1/05366; F28D 7/0066
See application file for complete search history.

(56) References Cited

U.S. PATENT DOCUMENTS 1,416,337 A * 5/1922 Deane ..... F28F 9/06 165/76
1,797,524 A * 3/1931 Dwyer ..... F28D 1/05333 165/76
(Continued)

FOREIGN PATENT DOCUMENTS

CN 102985779 A 3/2013
CN 104981677 A 10/2015
(Continued)

OTHER PUBLICATIONS

Extended European Search Report issued for EP Application No. 17744872.7 dated Jun. 21, 2019.

*Primary Examiner* — Devon Russell
(74) *Attorney, Agent, or Firm* — Banner & Witcoff, Ltd.

(57) ABSTRACT

A heat exchanger assembly includes first and second tanks having tube side walls, reservoirs formed therein, and apertures extending through the tube side walls. A flow tube having a plurality of fins on an exterior surface thereof, a first end, and a second end, the first end being received in an aperture of the first tank. A first seal is positioned between the flow tube and the first aperture. A retainer is positioned between the flow tube and the first aperture and between the first seal and the fins on the tube. A mounting block is positioned between the first tank and the fins on the tube, and is secured to the first tank. A second seal is positioned between the flow tube and the second aperture.

17 Claims, 11 Drawing Sheets

(51) Int. Cl.

| | |
|---|---|
| ***F28D 1/053*** | (2006.01) |
| ***F28D 7/00*** | (2006.01) |
| ***F28F 9/04*** | (2006.01) |

(56) References Cited

U.S. PATENT DOCUMENTS 1,886,645 A * 11/1932 Clarkson ..... F28D 1/0475 165/82
2,065,515 A * 12/1936 Cornell, Jr. ..... F28F 1/28 165/83
2,677,394 A * 5/1954 Brinen ..... F28F 13/12 138/38
2,688,986 A * 9/1954 O'Brien ..... F01P 11/08 138/38
3,391,732 A * 7/1968 Murray ..... F28D 1/0535 165/76
3,527,291 A * 9/1970 Neary ..... F24H 9/0052 165/83
4,106,558 A * 8/1978 Neveux ..... F28F 13/12 165/109.1
4,236,577 A * 12/1980 Neudeck ..... F28F 9/06 165/175
4,344,478 A * 8/1982 Petaja ..... F28F 9/06 165/175
4,441,547 A * 4/1984 Argyle ..... F28F 9/002 165/67
4,524,823 A * 6/1985 Hummel ..... F25B 39/028 165/174
4,651,821 A * 3/1987 Moranne ..... F28D 1/05333 165/175
4,657,069 A * 4/1987 Easton ..... F16L 3/223 165/76
4,709,689 A * 12/1987 Simcox ..... F28F 9/162 126/665
4,727,907 A * 3/1988 Duncan ..... F28F 13/12 138/38
5,062,476 A * 11/1991 Ryan ..... F28D 1/05383 165/149
5,342,470 A * 8/1994 Meirana ..... B29C 66/301 156/304.2
5,433,268 A * 7/1995 Janezich ..... F28D 1/053 165/175
5,562,153 A * 10/1996 Sasaki ..... B23P 15/26 165/151
5,782,291 A * 7/1998 Morita ..... F28D 1/05391 165/173
5,979,910 A * 11/1999 Shinohara ..... F16L 27/0832 277/616
6,161,614 A * 12/2000 Woodhull, Jr. ..... F28D 1/05333 165/144
6,964,297 B1 * 11/2005 Janezich ..... F28F 9/14 165/173
7,481,266 B2 * 1/2009 Demuth ..... F28D 1/0478 165/176
7,562,697 B2 * 7/2009 Gorbounov ..... F25B 39/028 165/174
2003/0221819 A1 * 12/2003 Jang ..... F28D 1/05391 165/173
2006/0037740 A1 * 2/2006 Durr ..... F28D 1/0535 165/176
2007/0209386 A1 * 9/2007 Higashiyama ..... B60H 1/00328 62/515
2008/0000625 A1 * 1/2008 Baylis ..... B29C 65/3644 165/173
2008/0264503 A1 * 10/2008 Smith ..... E21B 33/038 137/614.04
2009/0095458 A1 * 4/2009 Lim ..... F28F 9/0224 165/174
2009/0120625 A1 * 5/2009 Janezich ..... F28F 9/06 165/173
2009/0282850 A1 * 11/2009 Higashiyama ..... F25B 39/02 62/239
2010/0147501 A1 * 6/2010 Art ..... F28D 1/05391 165/175
2013/0081795 A1 * 4/2013 Janezich ..... F28F 9/0221 165/173
2013/0105127 A1 * 5/2013 Postma ..... F28D 7/16 165/157
2014/0225363 A1 * 8/2014 Burgers ..... F28F 9/0258 285/124.5

FOREIGN PATENT DOCUMENTS

| | | | |
|---|---|---|---|
| GB | 2086561 | A | 5/1982 |
| KR | 101478204 | B1 | 1/2015 |
| WO | 2007/137161 | A2 | 11/2007 |
| WO | 2011/151846 | A1 | 12/2011 |
| WO | 2015/119187 | A1 | 8/2015 |

* cited by examiner

HEAT EXCHANGER WITH TANKS, TUBES AND RETAINER

RELATED APPLICATIONS

This application is a continuation of U.S. application Ser. No. 15/008,505, filed Jan. 28, 2016, which is hereby incorporated herein by reference in its entirety for all purposes.

FIELD

Aspects of this invention relate generally to heat exchangers, and, in particular, to heat exchangers with tank and tube-and-fin assemblies, having improved tank construction and improved tube-to-tank sealing arrangements.

BACKGROUND

Heat exchangers typically are formed of a plurality of tube-and-fin assemblies, which are mounted and interconnected to a pair of opposed tanks. A heating or cooling fluid, e.g., oil, air, etc. flows from one tank into and through the tubes and then out through the second tank. Air is passed over the tubes and fins to add or remove heat from the fluid passing through the tubes. The heat exchanger must be able to withstand system operating pressures without leaking. Elastomeric seals, or seals of other materials, are sometimes used within the heat exchanger to provide suitable sealing between the tubes and the tanks.

It would be desirable to provide a heat exchanger that reduces or overcomes some or all of the difficulties inherent in prior known devices. Particular advantages will be apparent to those skilled in the art, that is, those who are knowledgeable or experienced in this field of technology, in view of the following disclosure of the invention and detailed description of certain embodiments.

Particular objects and advantages of the invention will be apparent to those skilled in the art, that is, those who are knowledgeable or experienced in this field of technology, in view of the following disclosure of the invention and detailed description of certain preferred embodiments.

SUMMARY

Aspects of the present invention may be used to advantageously provide a heat exchanger having advantageous pressure capabilities and improved performance.

In accordance with a first aspect, a heat exchanger assembly includes first and second tanks having tube side walls, reservoirs formed therein, and apertures extending through the tube side walls. A flow tube having a plurality of fins on an exterior surface thereof, a first end, and a second end, the first end being received in an aperture of the first tank. A first seal is positioned between the flow tube and the first aperture. A retainer is positioned between the flow tube and the first aperture and between the first seal and the fins on the tube. A mounting blocked is positioned between the first tank and the fins on the tube, and is secured to the first tank. A second seal is positioned between the flow tube and the second aperture.

In accordance with another aspect, a heat exchanger assembly includes first and second tanks having tube side walls, reservoirs formed therein, and a plurality of apertures extending through the tube side walls. Each of a plurality of flow tubes has a plurality of fins on an exterior surface thereof, a first end, and a second end, the ends being received in a corresponding aperture of the first and second tanks.

Each of a plurality of first seals is positioned between one of the flow tubes and an interior surface of a corresponding aperture in the first tank. Each of a plurality of retainers is positioned between one of the flow tubes and the interior surface of a corresponding aperture in the first tank and between the first seal and the fins on one of the flow tubes. Each of a plurality of mounting blocks is positioned between the first tank and the fins on the one of the flow tubes, and is secured to the first tank. Each of a plurality of second seals is positioned between one of the flow tubes and an interior surface of a corresponding aperture in the second tank.

From the foregoing disclosure, it will be readily apparent to those skilled in the art, that is, those who are knowledgeable or experienced in this area of technology, that preferred embodiments of a heat exchanger as disclosed herein provide a significant technological advance in terms of improved sealing and performance at high operating pressures. These and additional features and advantages will be further understood from the following detailed disclosure of certain preferred embodiments.

BRIEF DESCRIPTION OF THE DRAWINGS

FIG. 5 is a plan view of an alternative embodiment of the tube-and-fin assembly of FIG. 4, including baffle plates seated in channels of the tube.

Figure 1:
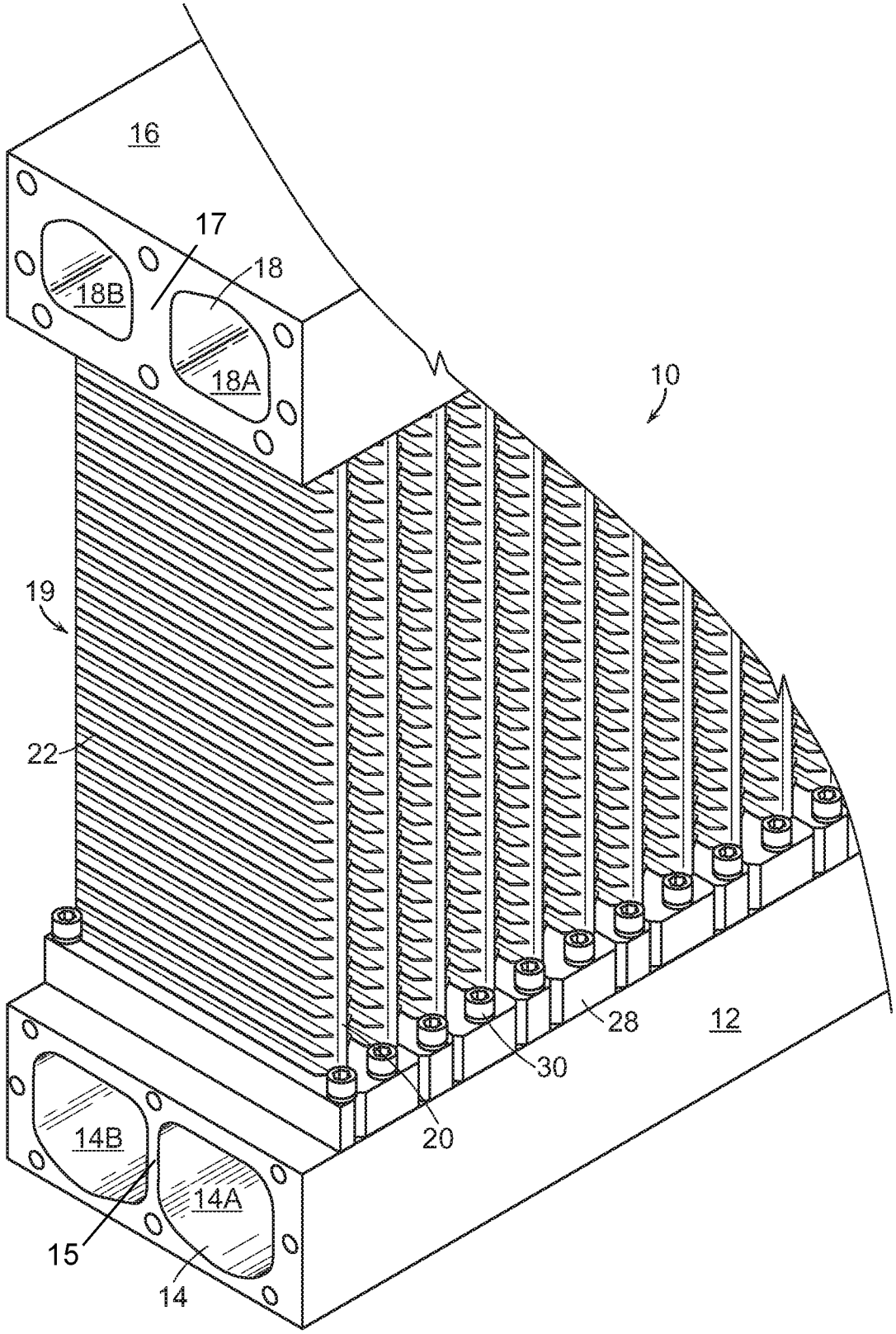
FIG. 1 is a schematic perspective view, shown partially broken away, of tube-and-fin assemblies mounted between opposed tanks of a heat exchanger.

The figures referred to above are not drawn necessarily to scale and should be understood to provide a representation of the invention, illustrative of the principles involved. Some features of the heat exchanger depicted in the drawings have been enlarged or distorted relative to others to facilitate explanation and understanding. The same reference numbers are used in the drawings for similar or identical components and features shown in various alternative embodiments. Heat exchangers as disclosed herein would have configurations and components determined, in part, by the intended application and environment in which they are used.

DETAILED DESCRIPTION OF CERTAIN PREFERRED EMBODIMENTS

The present invention may be embodied in various forms. An embodiment of a heat exchanger 10 is shown in FIG. 1, partially assembled and partially cut away, and is used to cool hot fluid, e.g., oil or air, generated in the use of industrial machinery, e.g., a hydraulic transmission, compressor, or turbocharger (not shown). It is to be appreciated that heat exchanger 10 could be used in certain embodiments to heat a cool fluid. In a typical application, hot fluid would flow through the inside of heat exchanger 10, while a cooling fluid such as air or another suitable cooling fluid would contact the outside of heat exchanger 10 thereby cooling the hot fluid.

It is to be understood, however, that the heat exchanger is not limited to use in cooling hot fluid in industrial machinery, and may easily be used with fluids or gases in other fields. For example, embodiments of the present invention find application in heat exchangers such as radiators used to cool an engine where coolant, such as water or antifreeze, flows through flow tubes and fluid such as air or a suitable liquid can be used to flow around the exterior of flow tubes. For convenience, the terms "upper" and "lower" and "top" and "bottom" are used herein to differentiate between the upper and lower ends of the heat exchanger and particular elements. It is to be appreciated that "upper" and "lower" and "top" and "bottom" are used only for ease of description and understanding and that they are not intended to limit the possible spatial orientations of the heat exchanger or its components during assembly or use.

Heat exchanger 10 includes a first tank 12 having a first reservoir 14 formed therein. In the illustrated embodiment, first tank 12 is a lower or bottom tank of heat exchanger 10. A second tank 16 having a second reservoir 18 formed therein is positioned opposite and spaced from first tank 12, and is referred to in the illustrated embodiment as an upper or top tank of heat exchanger 10. In certain embodiments, a web 15 may extend vertically within first reservoir 14 between the tube side wall and tank side wall of first tank 12, thereby dividing first reservoir into a first portion 14A and a second portion 14B. A corresponding web 17 may be formed in second tank 16, dividing second reservoir 18 into first portion 18A and second portion 18B.

Each of a plurality of tube-and-fin assemblies 19 includes a flow tube 20, and a plurality of fin elements or fins 22 secured to an exterior surface of each flow tube 20. Flow tubes 20 extend between first tank 12 and second tank 16. Fins 22 may be welded or otherwise secured to the exterior of flow tubes 20. It is to be appreciated that heat exchanger 10 can have any desired number of tube-and-fin assemblies 19.

Figure 6:
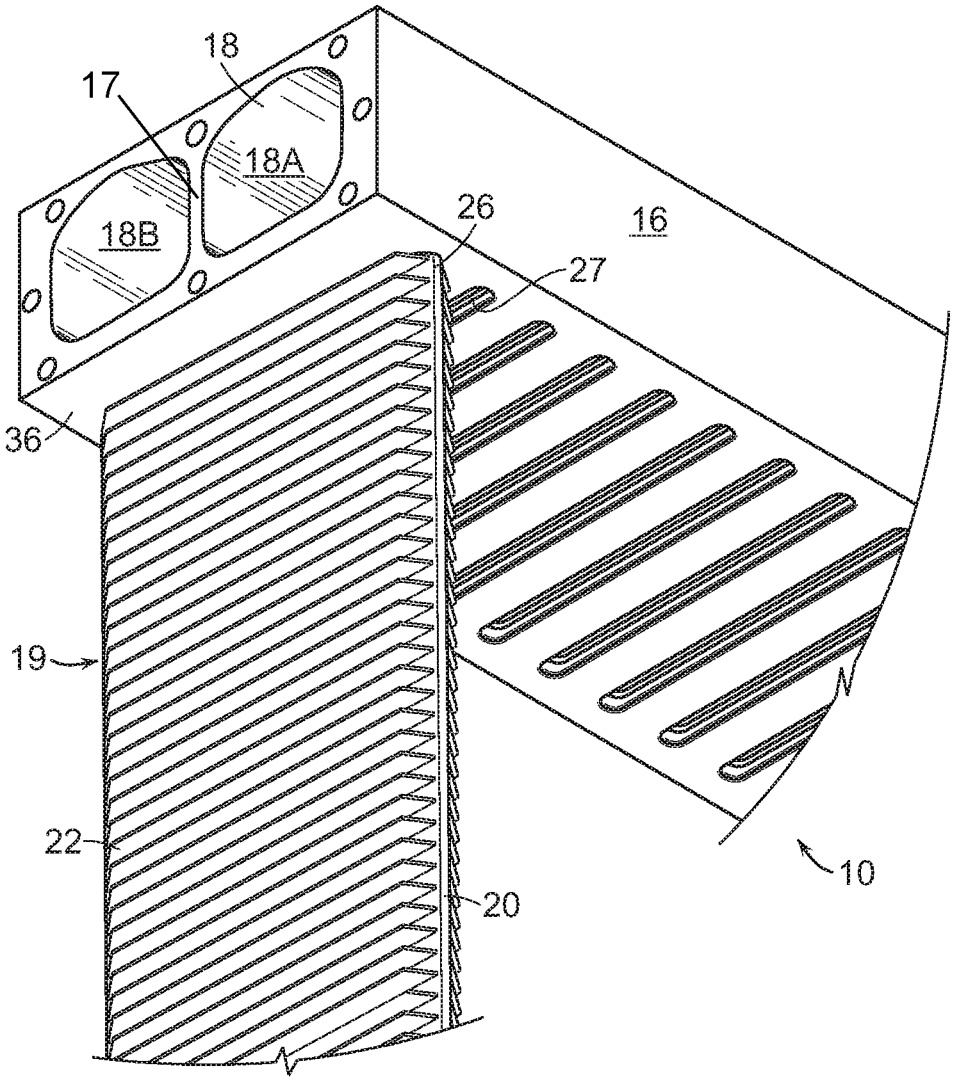
FIG. 6 is a schematic perspective view, shown partially broken away, of the second tank and tube-and-fin assembly of the heat exchanger of FIG. 1, shown with a second end of the tube inserted into the second tank.

A first or lower end 24 of each tube 20 is received in a first aperture 25 (seen in FIGS. 2 and 3) formed in first tank 12, as described in greater detail below. A second or upper end 26 of each tube 20 is received in a second aperture 27 formed in second tank 16, as seen in FIG. 6 and described in greater detail below.

First end 24 of tube 20 is secured within first tank 12 with a mounting block 28. Mounting block 28 is secured to first tank 12. In the illustrated embodiment, mounting blocks 28 are secured to first tank 12 by way of fasteners, such as bolts 30 that are received in threaded recesses 32, seen in FIGS. 2 and 3. It is to be appreciated that mounting block 28 can be secured to first tank 12 by other fasteners or any other fastening means. Other suitable fastening means will become readily apparent to those skilled in the art, given the benefit of this disclosure.

Adjacent mounting blocks 28 are configured and mounted to first tank 12 such that they abut one another along sides thereof, which helps to keep them in position when they are subject to the large pressures often produced within such heat exchangers 10. Positioning mounting blocks 28 in abutting relationship provides a structural advantage for heat exchanger 10, since the mounting blocks include apertures extending therethrough, as described below, and providing multiple mounting blocks abutting one another provides strength to one another to help withstand the high operating pressures of the heat exchanger.

As shown in FIG. 1, for illustration purposes, the length of tubes 20 is relatively short with respect to both the height of first and second tanks 12, 16, and the height of mounting block 28. It is to be appreciated that these proportions are not necessarily applicable for all applications, and that tubes 20 can have any desired length and, in fact, in many applications are significantly longer than the height of first and second tanks 12, 16 and the height of mounting block 28. Suitable lengths of tubes 20 will become readily apparent to those skilled in the art, given the benefit of this disclosure.

Figure 2:
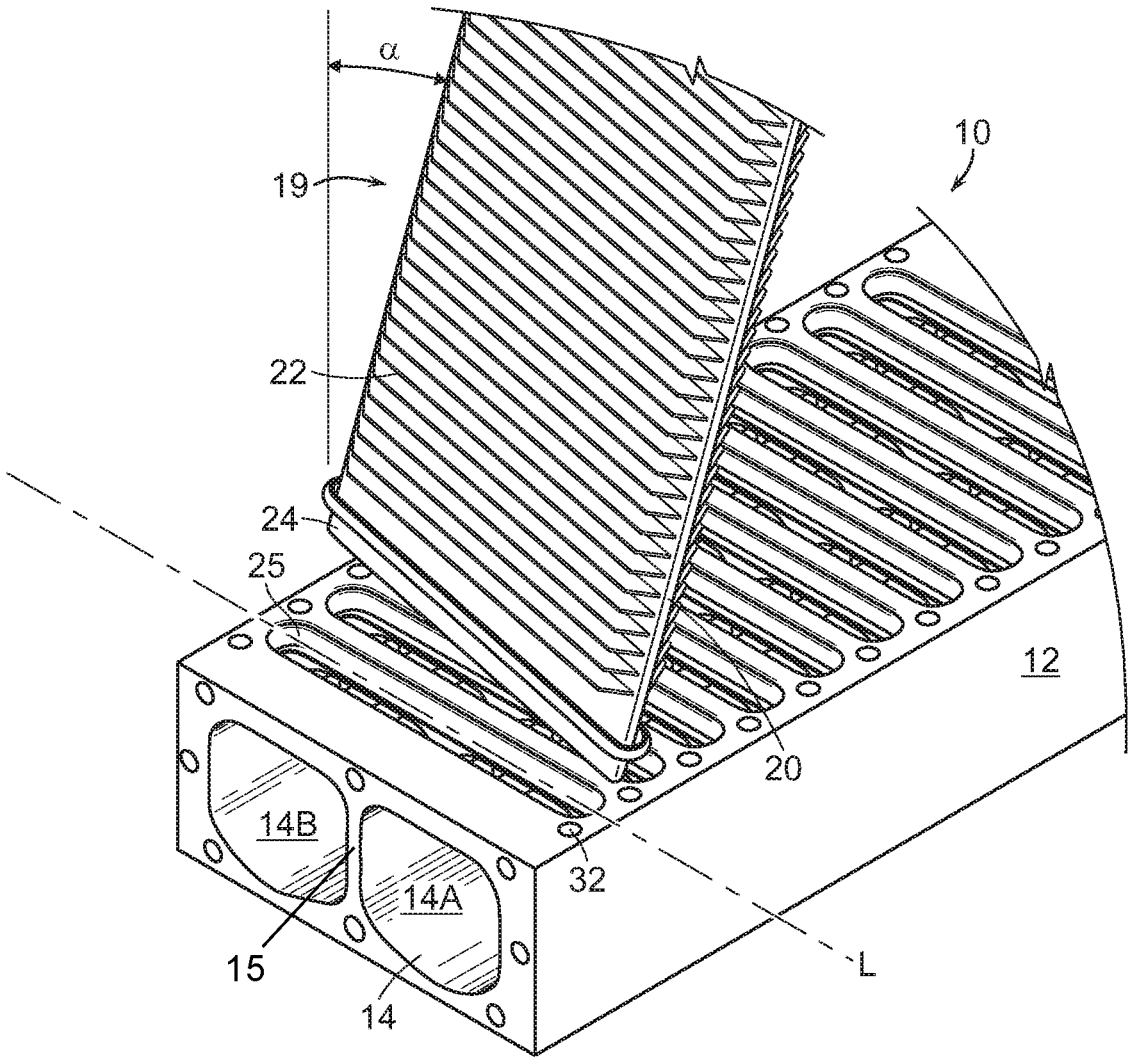
FIG. 2 is a schematic perspective view, shown partially broken away, of the first tank of the heat exchanger of FIG. 1, shown prior to the tube of the tube-and-fin assembly being inserted into the first tank.

As seen in FIG. 2, first tank 12 includes a plurality of first apertures 25, each of which receives a corresponding first end 24 of a tube 20. As illustrated here, tube 20 and first aperture 25, as well as second aperture 27 seen in FIG. 6, have a racetrack cross-sectional shape with a longitudinal axis L. It is to be appreciated that in certain embodiments, tubes 20, first apertures 25, and second apertures 27, may have cross-sectional shapes other than the racetrack shaped tube shown in FIG. 2. For example, they may have a circular or oval cross-section. Other suitable cross-sectional shapes for tubes 20, first apertures 25, and second apertures 27 will become readily apparent to those skilled in the art, given the benefit of this disclosure.

As seen in FIG. 2, prior to installation of tube 20, a first seal 34 is seated on first end 24 of tube 20. Tube 20 is then tilted along longitudinal axis L and first end 24 is inserted into first aperture 25 at this angle. The stepped opening of first aperture 25, described in greater detail below, allows for the angled insertion of tube 20 into first aperture 25. In certain embodiments, tube 20 is tilted at an angle α of between approximately 10° and approximately 15° with respect to the vertical.

As used herein, the term "approximately" is intended to mean "close to" or "about" a particular value, within the constraints of sensible, commercial engineering objectives; costs; manufacturing tolerances; and capabilities in the field of heat exchanger manufacture and use.

Figure 3:
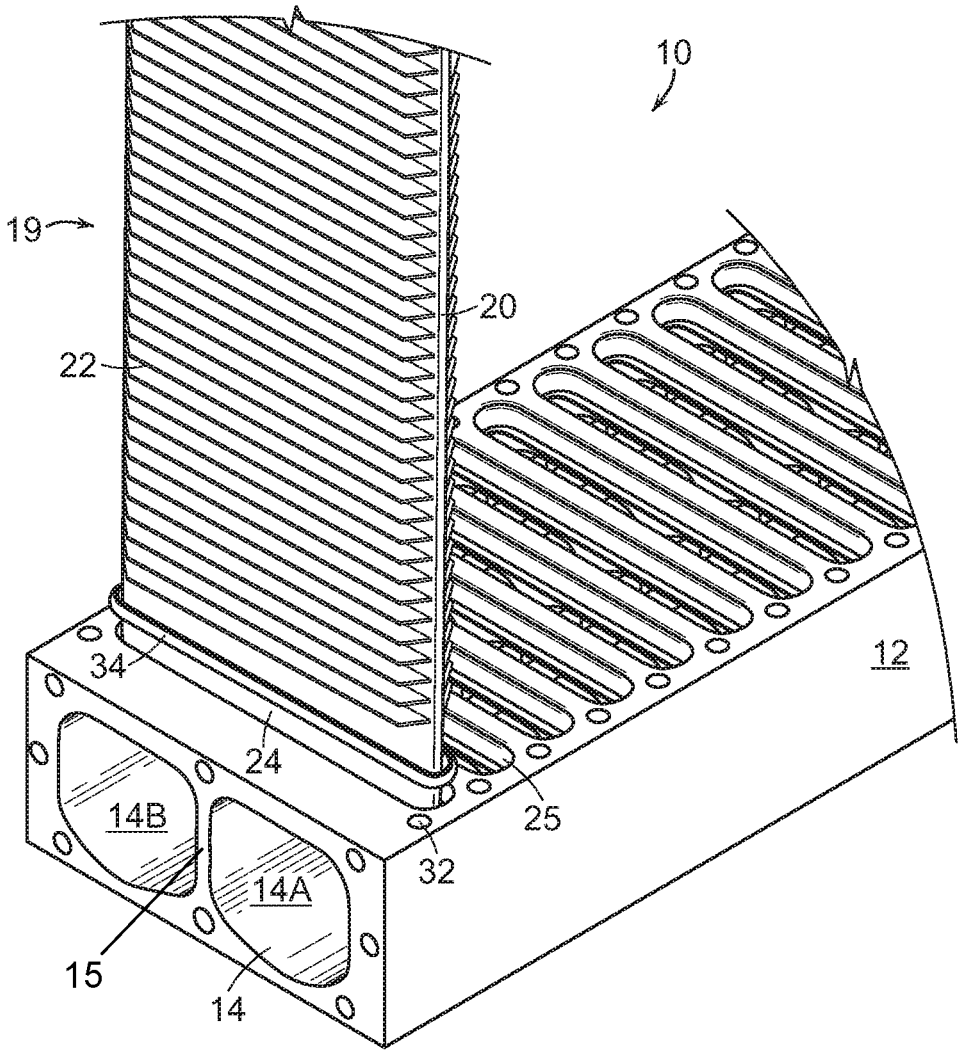
FIG. 3 is a schematic perspective view, shown partially broken away, of the first tank and tube-and-fin assembly of the heat exchanger of FIG. 1, shown with a first end of the tube inserted into the first tank.

Tube 20 is then tilted till it is oriented vertically as seen in FIG. 3 with first end 24 received in first aperture 25. As seen here, at this point during installation first seal 34 is positioned above tube side 38 of first tank 12 and first aperture 25.

Figure 4:
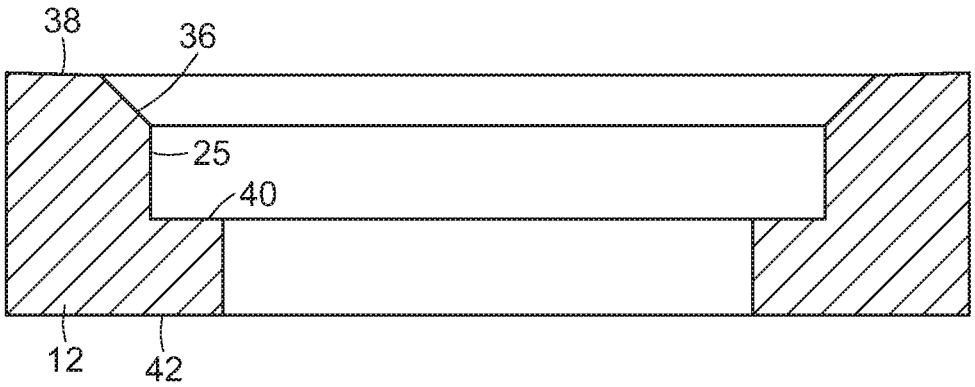
FIG. 4 is a section view of a first aperture in the first tank of the heat exchanger of FIG. 1, shown before the first end of the tube is be inserted therein.

As seen in FIG. 4, first aperture 25 is beveled, or chamfered at an edge 36 thereof at tube side 38 of first tank 12, which allows for easier insertion of first end 24 of tube 20 into first aperture 25, as described in greater detail below. In certain embodiments, beveled edge 36 is beveled at an angle of approximately 45°. A first shoulder 40 extends inwardly from an interior surface of first aperture 25 at a position away from beveled edge 36 and closer to a tank side 42 of first tank 12. First shoulder 40 engages first seal 34 when first end 24 of tube 20 is inserted into first aperture 25, as described in greater detail below.

Figure 5:
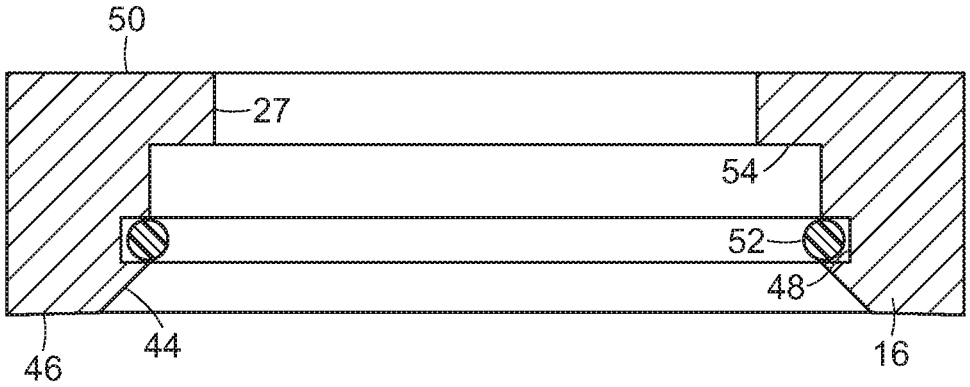
FIG. 5 is a section view of a second aperture in the second tank of the heat exchanger of FIG. 1, shown with a second seal seated therein and before the second end of the tube is inserted therein.

As seen in FIG. 5, second aperture 27 is also beveled, or chamfered at an edge 44 thereof at tube side 46 second tank 16, which allows for easier insertion of second end 26 of tube 20 into second aperture 27, as described in greater detail below. In certain embodiments, beveled edge 44 is beveled at an angle of approximately 45°. A channel, groove, or recess 48 is formed in the interior surface of second aperture 27 adjacent to beveled edge 44 and closer to a tank side 50 of second tank 16. A second seal 52 is seated in recess 48 and serves to provide a seal between second end 26 of tube 20 when tube 20 is inserted into second aperture 27. A second shoulder 54 extends inwardly from the interior surface of second aperture 27 at a position inwardly from recess 48 and closer to tank side 50 of second tank 16.

Figure 7:
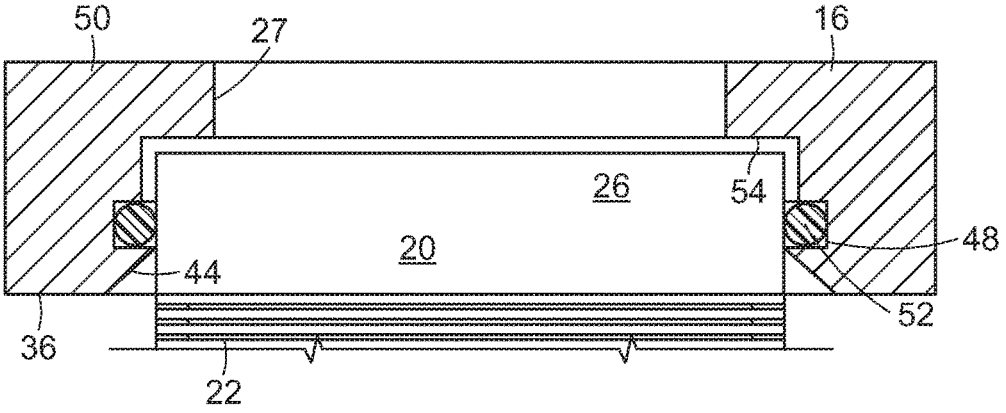
FIG. 7 is a section view of a second aperture in the second tank of the heat exchanger of FIG. 1, shown with the second end of the tube inserted therein.

Once tube 20 has been tilted to the vertical position, second end 26 is then moved upwardly into second aperture 27 of second tank 16, as illustrated in FIG. 6, until the uppermost fins 22 contact a tube side 36 of second tank 16. As seen in FIG. 7, when second end 26 is received in second aperture 27, second seal 52 is positioned within recess 48 and compressed therein by tube 20. At this point first end 24 of tube 20 is still seated within first aperture 25 of first tank 12.

Figure 8:
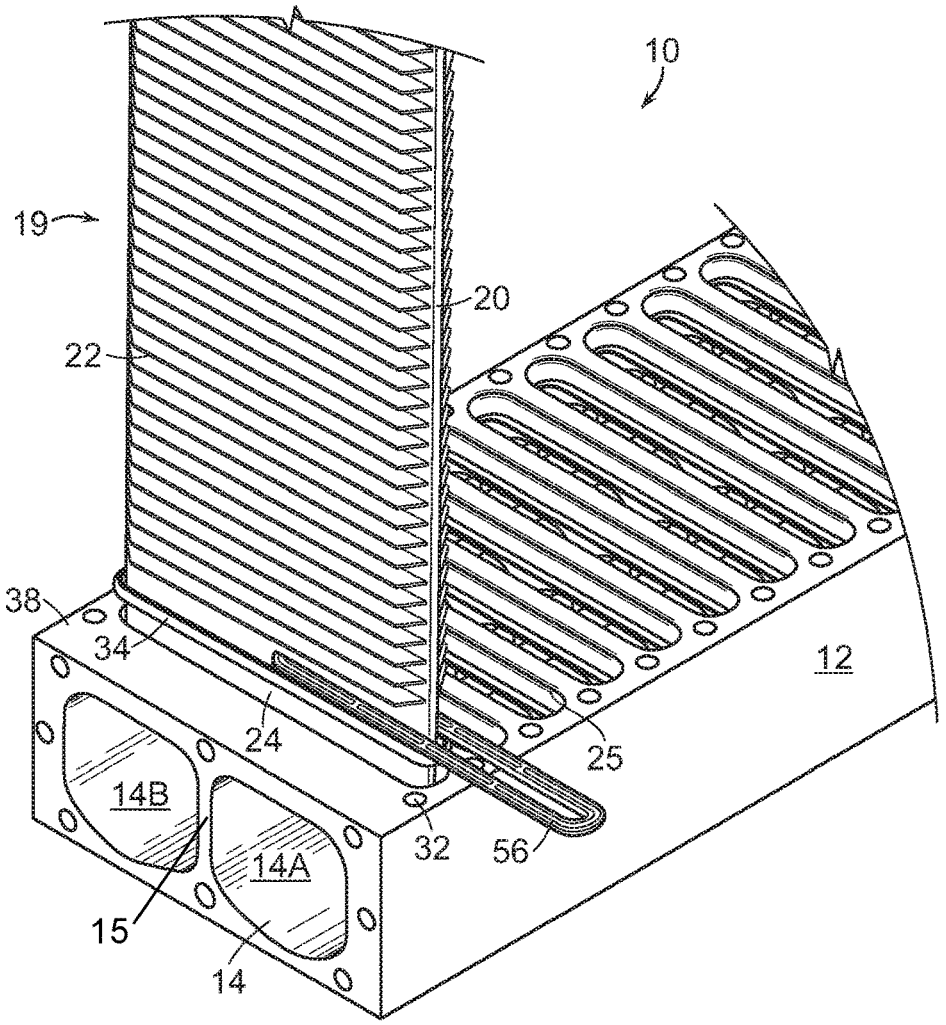
FIG. 8 is a schematic perspective view, shown partially broken away, of the first tank of the heat exchanger of FIG. 1, showing a retainer partially in place on the first end of the tube.
Figure 9:
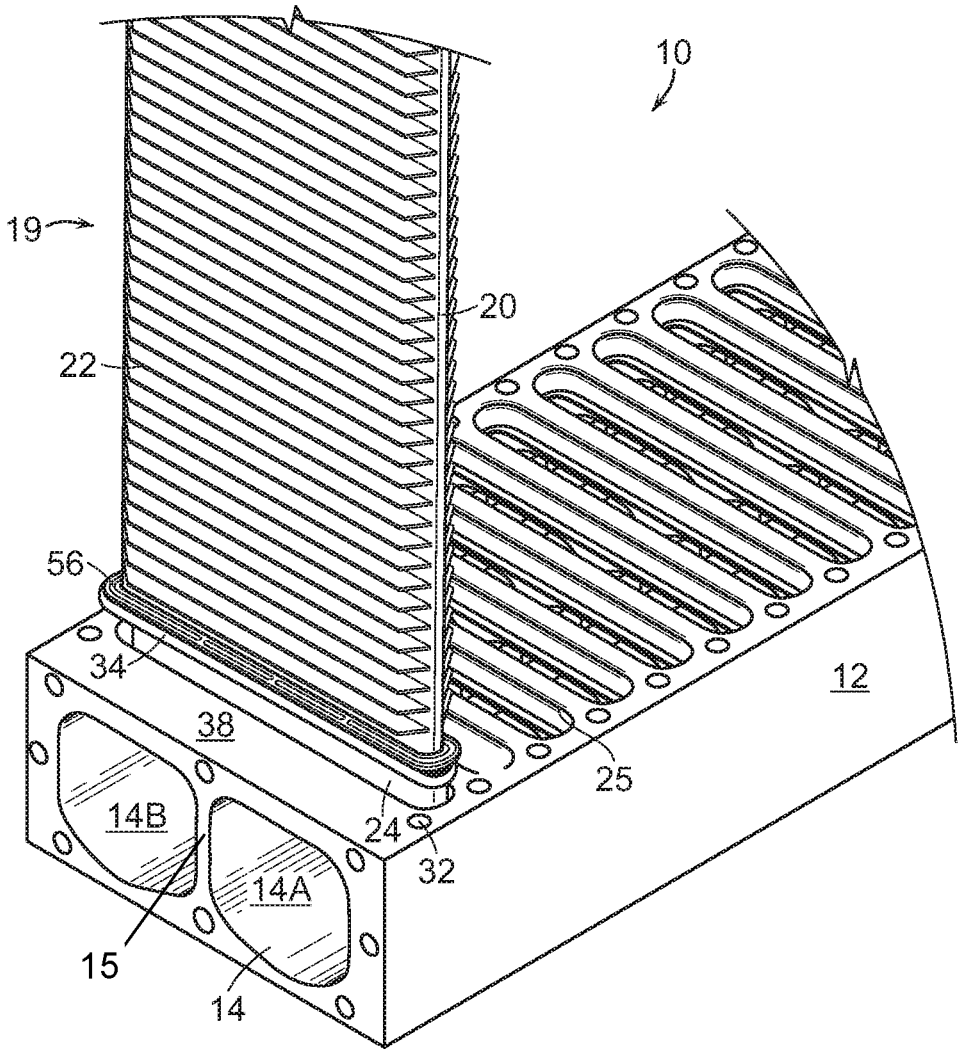
FIG. 9 is a schematic perspective view, shown partially broken away, of the first tank of the heat exchanger of FIG. 1, showing the retainer completely in place on the first end of the tube.

As seen in FIG. 8 a retainer 56 is then positioned around first end 24 of tube 20 above first seal 34. In the illustrated embodiment, retainer 56 has a racetrack shape like that of first seal 34, but is vertically split so that it can be expanded and slid onto the exterior of first end 24 of tube 20 above first seat 34. Retainer 56 can be seen fully seated around first end 24 of tube 20 in FIG. 9.

Figure 10:
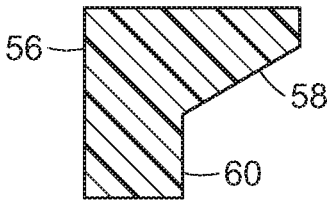
FIG. 10 is a section view of the retainer of FIG. 9.

In certain embodiments, as seen in FIG. 10, retainer 56 may have a shoulder 58 formed on a peripheral outer edge 60 of retainer 56. In the illustrated embodiment, engagement surface 58 is formed as a shoulder that extends upwardly and outwardly at an angle from a central portion of peripheral outer edge 60. Shoulder 58 may engage with beveled edge 36 in first aperture 25 when first end 24 of tube 20 is inserted into first aperture 25. In certain embodiments, shoulder 58 extends at angle of approximately 45°. It is to be appreciated that in other embodiments retainer 56 has a rectangular cross-section.

In certain embodiments, retainer 56 is formed of a plastic, such as a nylon plastic, for example. It is to be appreciated that retainer 56 could be formed of a metal, such as aluminum, for example. Other suitable materials for retainer 56 will become readily apparent to those skilled in the art, given the benefit of this disclosure.

Figure 11:
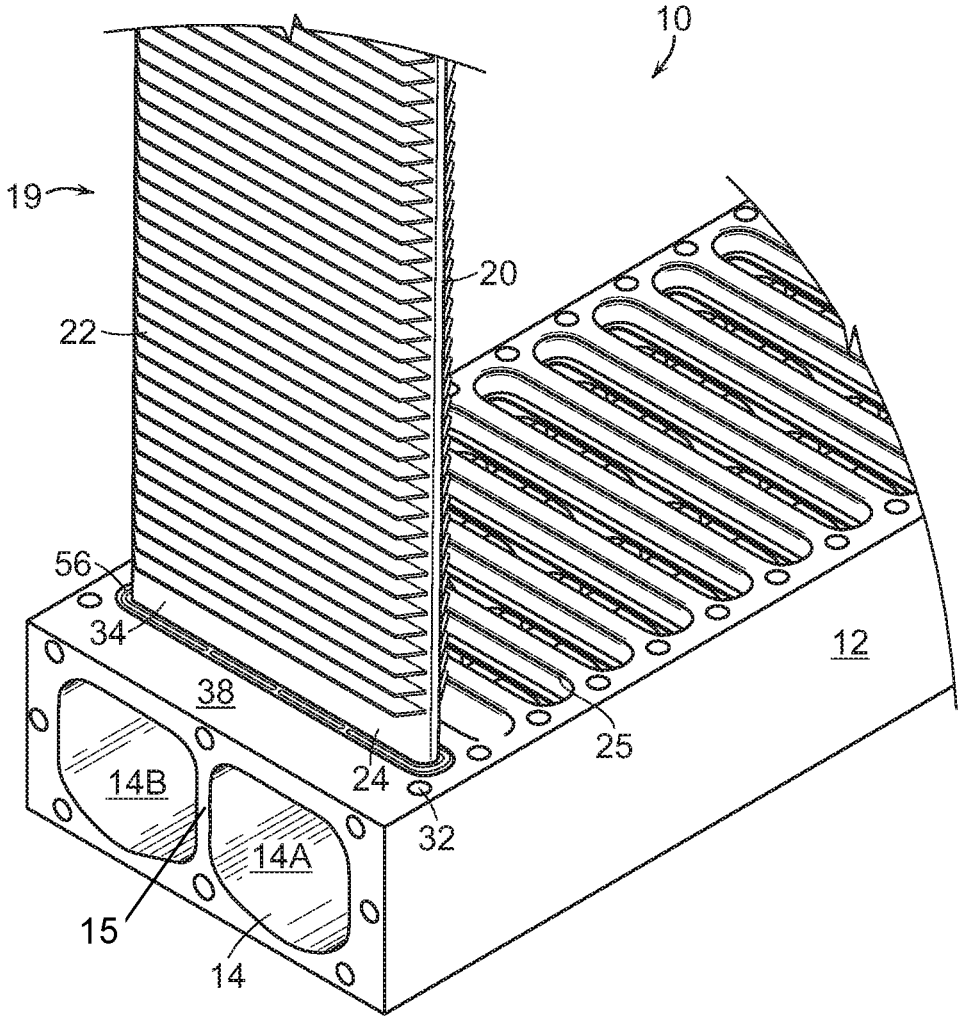
FIG. 11 is a schematic perspective view, shown partially broken away, of the first tank of the heat exchanger of FIG. 1, shown with the retainer and first seal fully inserted into the first aperture of the first tank.
Figure 12:
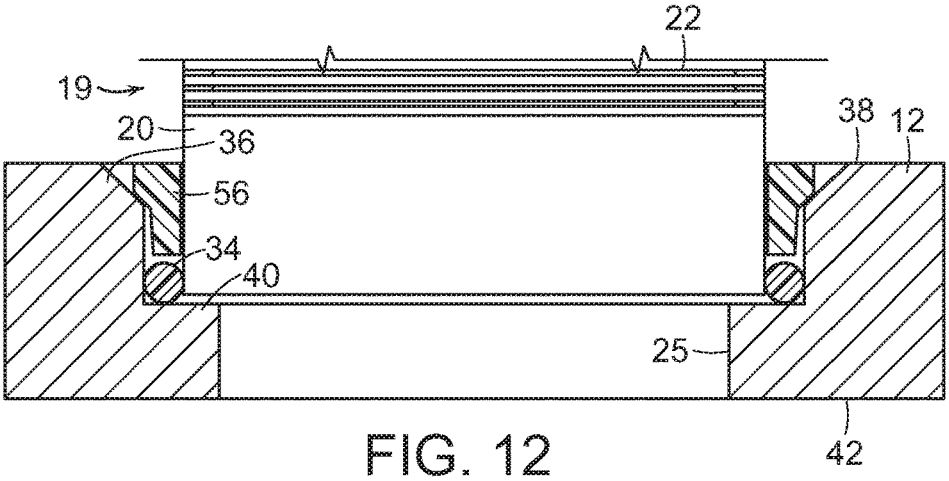
FIG. 12 is a section view of the first aperture in the first tank of FIG. 1, shown with the first end of the tube inserted therein.

After retainer 56 is fully engaged about first end 24 of tube 20, first end 24 is then pressed downwardly into first aperture 25. As retainer 56 moves downwardly into first aperture 25, it pushes first seal 34 into first aperture 25 of first tank 12, as seen in FIGS. 11-12.

Figure 13:
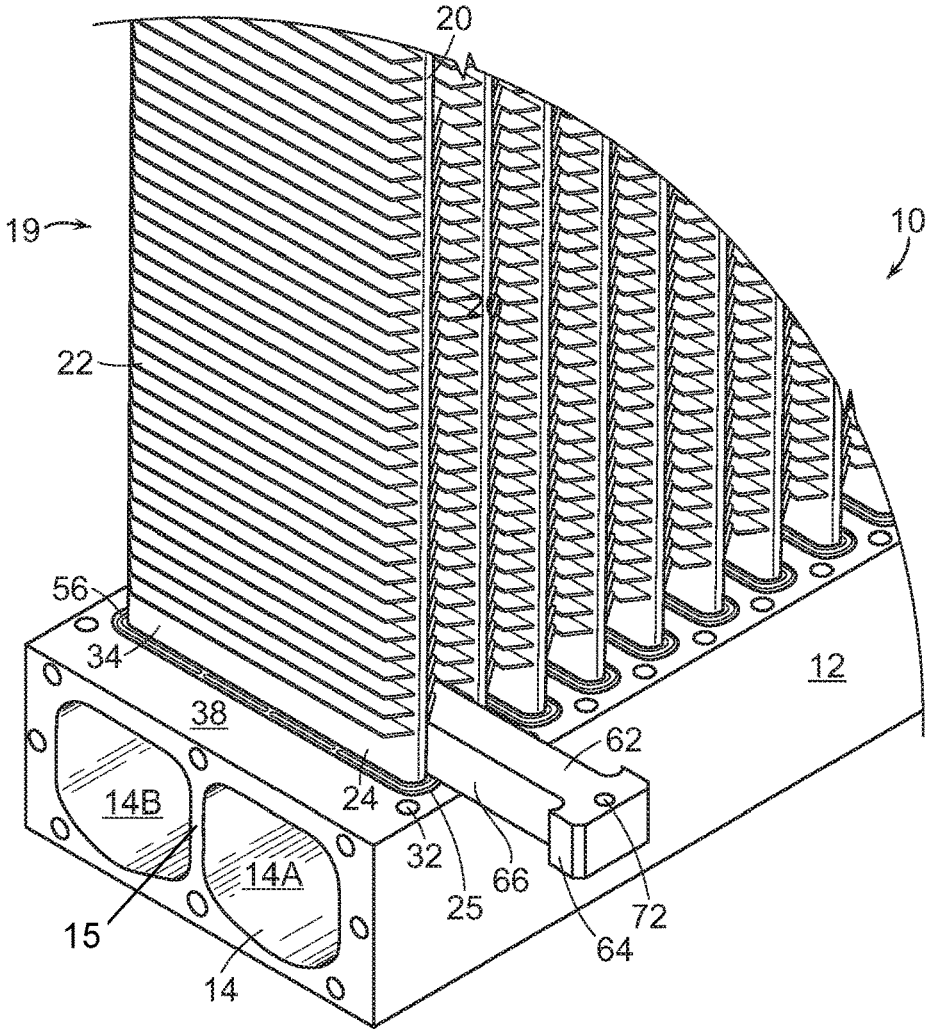
FIG. 13 is a schematic perspective view, shown partially broken away, of the first tank of the heat exchanger of FIG. 1, shown with a plurality of tube-and-fin assemblies inserted therein and a mounting block being positioned in the heat exchanger.
Figure 14:
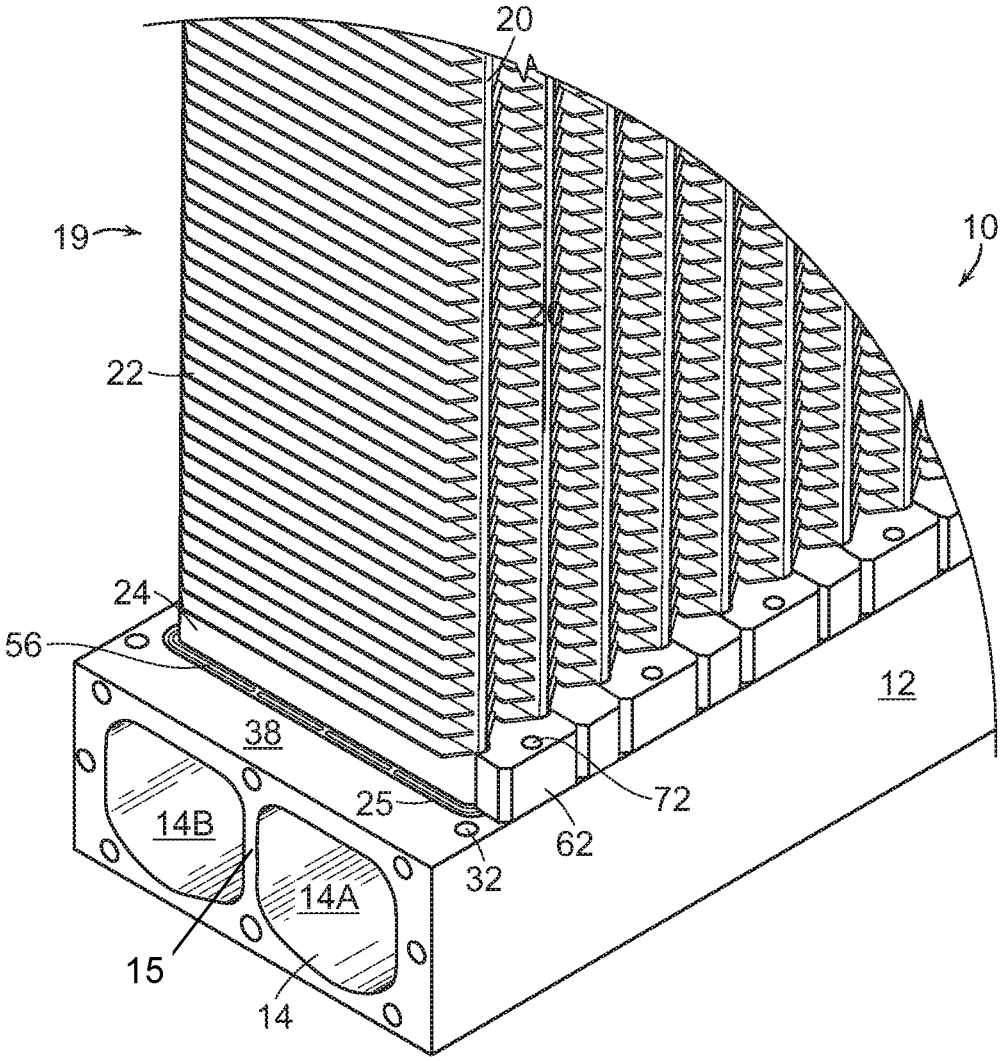
FIG. 14 is a schematic perspective view, shown partially broken away, of the first tank of the heat exchanger of FIG. 1, shown with a plurality of mounting blocks in position between adjacent tube-and-fin assemblies.

A mounting block 62 is then slid into position adjacent tube 20 between the lower most fins 22 and first tank 12, as seen in FIG. 13. As illustrated here, a plurality of tubes 20 are shown with first ends 24 thereof inserted into corresponding first apertures 25 in first tank 12. The mounting block 62 seen here, which is being slid into position between adjacent tubes 20, is substantially T-shaped. In certain embodiments, the intersection between the arms 64 and the base 66 is curved so as to nest against the curved end of tube 20. FIG. 14 illustrates a plurality of T-shaped mounting blocks 62 in position, each seated between adjacent tubes 20.

Figure 15:
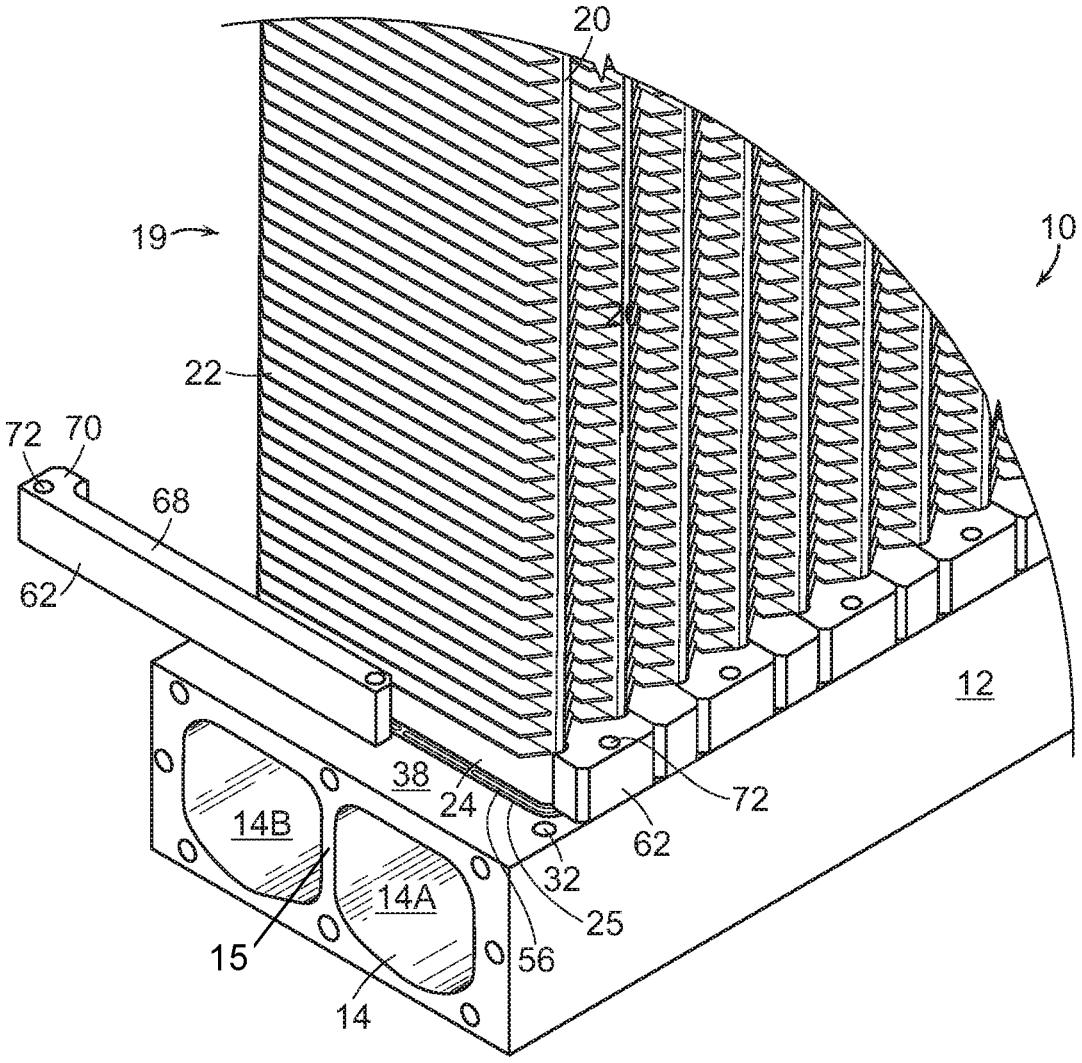
FIG. 15 is a schematic perspective view, shown partially broken away, of the first tank of the heat exchanger of FIG. 1, shown with a mounting block being positioned adjacent an endmost tube-and-fin assembly.

In certain embodiments, as illustrated in FIG. 15, an endmost mounting block 62, which is positioned against an exterior surface of a single tube 20 is substantially L-shaped, with an intersection between a long arm 68 and a short arm 70 of the L-shape being curved so as to nest against the curved end of tube 20.

The mounting blocks 62 are secured to first tank with bolts 30 that extend through apertures 72 formed in mounting blocks 62 and are threadingly received in recesses 32 in first tank 16, as seen in FIG. 1.

In use, first seal 34 and second seal 52 are compressed a predetermined amount to provide a proper seal between the tube 20, first tank 12, and second tank 16. It is to be appreciated that seals 34, 52 can have differing sizes and shapes. For example, the seals could have a circular cross-section, such as those seals commonly known as "O-rings." Other useful seals include those having a square or rectangular cross-section or a cross-section resembling that of an "X." Other suitable seal shapes will become readily apparent to those skilled in the art, given the benefit of this disclosure, and the configuration of the elements within which the seal is seated.

In certain embodiments, seals 34, 52 are fashioned from an elastomeric material. In certain embodiments, seals 34, 52 may be formed of fluorocarbon, silicone, nitrile, ethylene propylene, or fluorosilicone, for example. In certain applications, seals 34, 52 are formed of a material that is suitable for long term exposure to elevated temperatures, which may degrade elastomeric materials. A flexible graphite type material, for example, may provide a long life span when exposed to elevated temperatures. Useful seals are capable of withstanding operating pressures and temperatures of a given heat exchanger, and are also resistant to degradation by fluids used in a given heat exchanger. The seals may be installed by hand or by suitable instrument so as to seat the seal into a given location. Other suitable materials used to form seals 34, 52 will become readily apparent to those skilled in the art, given the benefit of this disclosure.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A heat exchanger assembly comprising:

a first tank having a tube side wall, a first reservoir formed therein, a first web formed in the first tank and defining a first portion and a second portion of the first reservoir, and a first aperture extending through the tube side wall of the first tank;

a flow tube having a plurality of fins on an exterior surface thereof, a first end, and a second end, the first end being received in the first aperture of the first tank;

a first seal positioned between the flow tube and an interior surface of the first aperture;

a retainer positioned between the flow tube and the interior surface of the first aperture and between the first seal and the fins on the flow tube; and a mounting block positioned between the first tank and the fins on the flow tube, and being directly secured to the first tank;

a second tank having a tube side wall, a second reservoir formed therein, a second web formed in the second tank and defining a first portion and a second portion of the second reservoir, and a second aperture extending through the tube side wall of the second tank, the second end of the flow tube being received in the second aperture of the second tank; and a second seal positioned between the flow tube and an interior surface of the second aperture.

2. The heat exchanger assembly of claim 1, wherein the first web extends between the tube side wall and a tank side wall of the first tank, and the second web extends between the tube side wall and a tank side wall of the second tank.

3. The heat exchanger assembly of claim 1, wherein the flow tube has a racetrack shaped cross section.

4. The heat exchanger assembly of claim 1, wherein the retainer has a racetrack shape.

5. The heat exchanger assembly of claim 4, wherein the retainer is split.

6. The heat exchanger assembly of claim 1, further comprising a shoulder formed on a peripheral outer edge of the retainer.

7. The heat exchanger assembly of claim 6, wherein a bottom edge of the shoulder extends upwardly and outwardly.

8. The heat exchanger assembly of claim 7, wherein the bottom edge of the shoulder extends upwardly and outwardly at an angle of approximately 45°.

9. A heat exchanger assembly comprising:

a first tank having a tube side wall, a first reservoir formed therein, a first web formed in the first tank defining a first portion and a second portion of the first reservoir, and a plurality of first apertures extending through the tube side wall of the first tank;

a plurality of flow tubes, each tube having a plurality of fins on an exterior surface thereof, a first end, and a second end, the first end being received in a corresponding first aperture of the first tank;

a plurality of first seals, each first seal being positioned between one of the flow tubes and an interior surface of the corresponding first aperture;

a plurality of retainers, each retainer being positioned between one of the flow tubes and the interior surface of the corresponding first aperture and between the first seal and the fins on the one of the flow tubes;

a plurality of mounting blocks, each mounting block being positioned between the first tank and the fins on the one of the flow tubes, and being directly secured to the first tank;

a second tank having a tube side wall, a second reservoir formed therein, a second web formed in the second tank and defining a first portion and a second portion of the second reservoir, and a plurality of second apertures extending through the tube side wall of the second tank, the second end of each of the flow tubes being received in a corresponding second aperture of the second tank; and a plurality of second seals, each second seal being positioned between one of the flow tubes and an interior surface of a corresponding second aperture.

10. The heat exchanger assembly of claim 9, wherein the first web extends between the tube side wall and a tank side wall of the first tank, and the second web extends between the tube side wall and a tank side wall of the second tank.

11. The heat exchanger assembly of claim 9, wherein each flow tube has a racetrack shaped cross section.

12. The heat exchanger assembly of claim 9, wherein each retainer has a racetrack shape.

13. The heat exchanger assembly of claim 12, wherein each retainer is split.

14. The heat exchanger assembly of claim 9, further comprising a shoulder formed on a peripheral outer edge of each retainer.

15. The heat exchanger assembly of claim 14, wherein a bottom edge of each shoulder extends upwardly and outwardly.

16. The heat exchanger assembly of claim 15, wherein the bottom edge of each shoulder extends upwardly and outwardly at an angle of approximately 45°.

17. The heat exchanger assembly of claim 15, wherein the mounting blocks abut one another.

* * * * *